US007634989B2

(12) United States Patent
Ignatiev

(10) Patent No.: US 7,634,989 B2
(45) Date of Patent: Dec. 22, 2009

(54) APPARATUS AND METHOD TO PULVERIZE ROCK USING A SUPERCONDUCTING ELECTROMAGNETIC LINEAR MOTOR

(75) Inventor: Alex Ignatiev, Houston, TX (US)

(73) Assignee: The University of Houston System, Houston, TX (US)

( * ) Notice: Subject to any disclaimer, the term of this patent is extended or adjusted under 35 U.S.C. 154(b) by 621 days.

(21) Appl. No.: 11/445,916

(22) Filed: Jun. 2, 2006

(65) Prior Publication Data

US 2007/0277797 A1 Dec. 6, 2007

(51) Int. Cl.
*F41B 6/00* (2006.01)
*F41F 1/00* (2006.01)

(52) U.S. Cl. ..... 124/3; 89/8

(58) Field of Classification Search ..... 124/3, 124/54; 89/8; 310/12; 318/38, 135
See application file for complete search history.

(56) References Cited

U.S. PATENT DOCUMENTS 3,589,300 A * 6/1971 Wipf ..... 104/281
4,795,113 A * 1/1989 Minovitch ..... 244/63
4,966,884 A * 10/1990 Hilal ..... 505/164
2007/0234893 A1 * 10/2007 Lockner et al. ..... 89/8
2008/0053299 A1 * 3/2008 Taylor ..... 89/8

* cited by examiner

*Primary Examiner*—Troy Chambers
(74) *Attorney, Agent, or Firm*—Robert W. Strozier

(57) ABSTRACT

A rock pulverizer device based on a superconducting linear motor. The superconducting electromagnetic rock pulverizer accelerates a projectile via a superconducting linear motor and directs the projectile at high speed toward a rock structure that is to be pulverized by collision of the speeding projectile with the rock structure. The rock pulverizer is comprised of a trapped field superconducting secondary magnet mounted on a movable car following a track, a wire wound series of primary magnets mounted on the track, and the complete magnet/track system mounted on a vehicle used for movement of the pulverizer through a mine as well as for momentum transfer during launch of the rock breaking projectile.

41 Claims, 8 Drawing Sheets

APPARATUS AND METHOD TO PULVERIZE ROCK USING A SUPERCONDUCTING ELECTROMAGNETIC LINEAR MOTOR

GOVERNMENTAL INTEREST

The U.S. Government has a paid-up license in this invention, and the right in limited circumstances to require the patent owner to license others on reasonable terms as provided for by the terms of a grant awarded by the National Aeronautics and Space Administration (NASA).

BACKGROUND OF THE INVENTION

1. Field of the Invention

The invention relates generally to a method and apparatus for pulverizing a formation including useable raw materials such as an ore, coal or the like using a high speed projectile accelerator to hurl projectiles at the formation to breakup or pulverize a portion of an exposed surface of the formation.

More particularly, the invention relates to an apparatus for hurling one projectile or a plurality of projectiles at an exposed surface of a formation including a projectile car mounted on a track having two parallel rails, where the car includes a trapped field magnet and the track includes a plurality of electromagnets that can be turned on and off as the car moves down the track accelerating the car to a desired velocity. The apparatus also includes a stop assembly at its distal end designed to engage and nearly instantaneously stop the forward motion of the car expelling the projectile or the projectiles disposed in a projectile holder on the car. If the distal end of the apparatus is positioned adjacent a surface, then the projectile would impact the surface breaking or pulverizing the surface. The invention also relates to a method for breaking up or pulverizing a surface using the apparatus of this invention. In one embodiment, the apparatus comprises a superconducting linear motor.

2. Description of the Related Art

The mining industry has a significant need for an apparatus and method to breakup large rock sections loosened during mining operations such as blasting or other means. These rock sections can be up to 30 cubic meters in volume, and require break up into smaller pieces for transport out of the mine. Several approaches have been tried including: (1) additional blasting—this is not necessarily cost effective due to the need for drilling new set-charge holes, setting new charges, evacuating the mine and removing the residual gas; (2) steam/compressed air hammers—this requires a source of steam or compressed air and is limited as to hammer size and velocity; and (3) rf induction heating to fractionate—this requires water porosity of the rock structure, large and inefficient rf transmitters and safety procedures to protect against high levels of rf radiation. To pulverize a 30 cubic meter section of rock, energy of approximately 1 Mjoule is required. As an example, for a projectile launcher, this would require a projectile of approximately 1,000 kg at a speed of about 33 meters/sec (about 75 miles/hr). These requirements show the inadequacy of using a steam/compressed air hammer approach to break rock.

Electromagnetic motors have been described for the acceleration of a mass for warfare applications as in a rail gun in U.S. Pat. No. 5,078,043 (column 5) which patent is incorporated herein by this reference. The inclusion of superconducting material to a rail gun has also been described in U.S. Pat. No. 4,901,621 (column 2), which patent is incorporated herein by this reference.

There is a need, therefore, for a system (such as an electromagnetic launch system) to accelerate a projectile to the required speed over moderate lengths compatible with mine dimensions and mine operations and cause pulverization of rock with the projectile.

SUMMARY OF THE INVENTION

The apparatus of the present invention is a trapped field superconducting secondary magnet mounted on a movable car following a track, a wire wound series of primary magnets mounted on the track, and the complete magnet/track system mounted on a vehicle used for movement of the pulverizer through a mine and for momentum transfer during launch of the rock breaking projectile The method of the present invention accelerates a projectile via a superconducting linear motor and directs the projectile at high speed toward a rock structure that is to be pulverized by collision of the speeding projectile with the rock structure.

BRIEF DESCRIPTION OF THE DRAWINGS

The invention can be better understood with reference to the following detailed description together with the appended illustrative drawings in which like elements are numbered the same.

DETAILED DESCRIPTION OF THE INVENTION

Figure 1A:
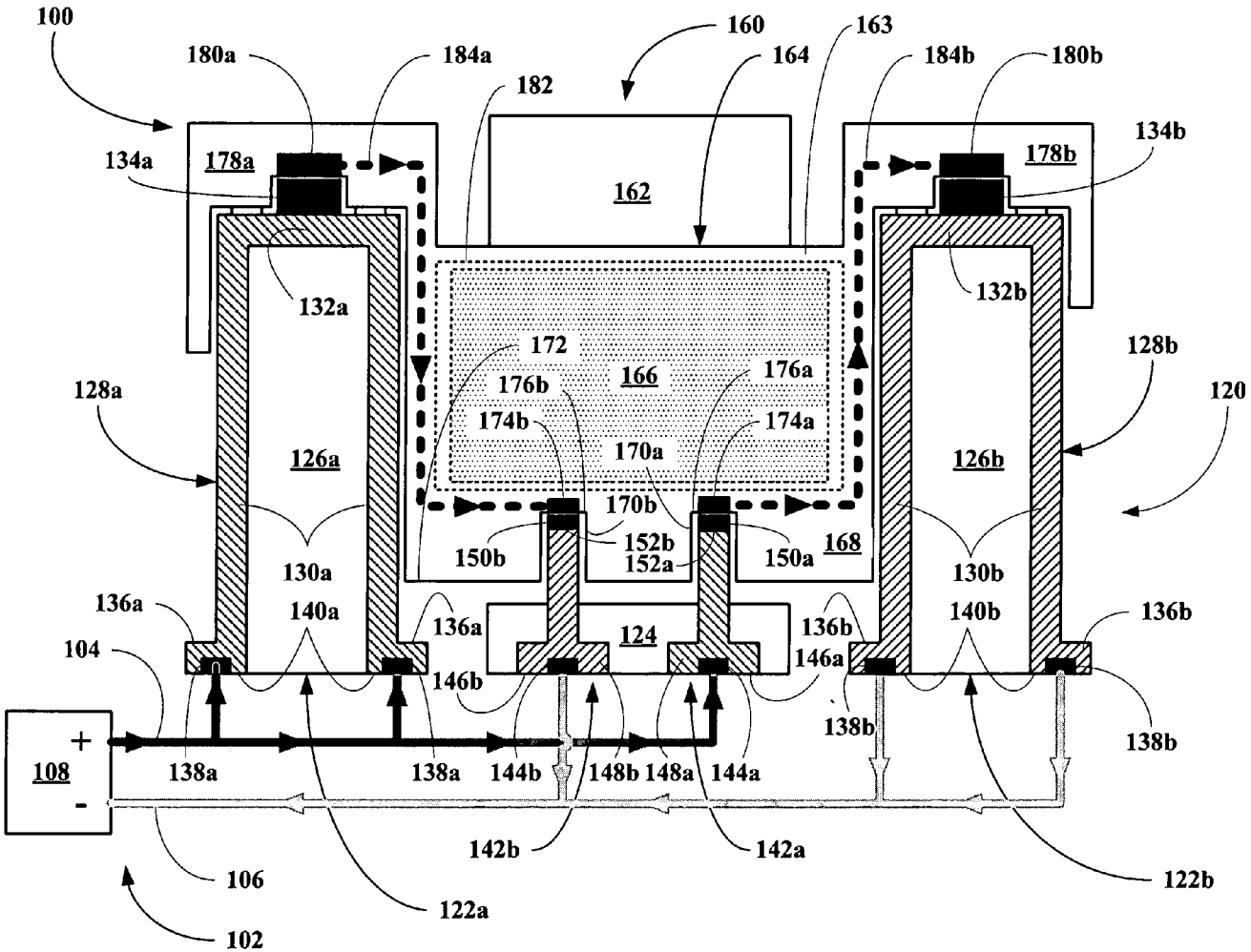
FIGS. 1A&B depict an embodiment of a track system of this invention.

The inventor has found that a rock pulverizing system can be constructed including a rail system having a car adapted to move along the rail system via magnetic forces produced by primary winding in the rail system and a trapped field magnet in the car. The rail system also includes a car breaking or deceleration system which stops the car after its is accelerated via magnetic attraction between successively activated primary winding and the trapped field magnet in the car. The car supports a projectile, which can be retrievable or expendable, and which is ejected from the car when the car is decelerated by the deceleration system. The deceleration or breaking occurs in such as way that the project is dispelled from the car with sufficient momentum to pulverize a target earth/rock formation. If the projectile is retrievable, then after the project is ejected and impinges on the target, the projectile is retrieved and repositioned on the car. The car is then return to its start position so that the car can again be accelerated down the track and decelerate ejecting the projectile at a new target. If the projectile is expendable, then the car is repositioned and a new expendable projectile is loaded onto the car so that the car can again be accelerated down the track and decelerate ejecting the projectile at a new target.

The superconducting rock pulverizer presented here uses a superconducting linear motor containing monolithic $YBa_2Cu_3O_{7-x}$ trapped field superconducting magnet as the moving secondary magnet of the linear motor, and a series of wire-wound primary magnets located along a track on which the secondary superconducting magnet travels.

The secondary magnet is formed preferably from high temperature superconducting $YBa_2Cu_3O_{7-x}$ elements. It can also be formed from other bulk or thin film superconducting materials including BiSrCaCuO, ThSrCaCuO, HgSrCaCuO, $MgB_2$, TiNb, or other high temperature or low temperature superconducting material. To form the superconducting secondary magnet, the superconductors are cooled to below their critical temperature, Tc, while in a magnetic field of appropriate magnitude for the rock pulverizer. Thus, the superconductors capture the magnetic flux and become magnets. They remain magnets as long as they are kept at a temperature below Tc. For the high temperature superconductor $YBa_2Cu_3O_{7-x}$ it is preferable to cool with liquid nitrogen the boiling point of which (77K is well below the critical temperature of 91K. Cooling can also be accomplished by various cryocooler means. The superconducting elements comprising the secondary magnet can be stacked so as to maximize force applied to the secondary by the primary magnet. The size and shape of the secondary magnet elements are tailored for the required final velocity and mass of the projectile under acceleration over the desired lengths of the linear motor track (often as defined by the design parameters of the mine). The mass of the projectiles can range from about 50 kg to 2000 kg or more. The secondary superconducting magnet is attached to a car that moves on the track formed by the primary coil magnets.

The primary coil magnets are linearly stacked and are energized as the secondary magnet approaches, and are de-energized when the secondary magnet passes. The primary coil magnets can be energized with current by direct contact through brushes on the secondary magnet car or via a contactless mode. The primary coils or electromagnets can be made of wire comprised of copper, aluminum, or other metallic materials, or superconducting materials or mixture or combinations thereof. The superconducting wire can be of high temperature superconductors such as $YBa_2Cu_3O_{7-x}$, BiSrCaCuO, ThSrCaCuO, HgSrCaCuO, or other high temperature superconductors, or of other superconductors such as $MgB_2$ or TiNb or mixtures or combinations thereof. Higher operating temperature wire can be more beneficial as costs of insulation and heat loss are reduced.

The superconducting linear motor has a track length along which the secondary travels, that is defined by the critical transit dimensions of the mine, and by the required force and resultant acceleration and final velocity applied by the secondary magnet to the projectile over the length of the primary coil and track system. The superconducting secondary magnet is attached to a car that follows the primary track and had accommodations for brush contact or non-contact energizing of the primary coil sections as the car passes. The car holds the projectile, and projectile retrieve system for tethered projectiles. The car rides on the track with sliding or bearing contact, or has the possibility of being levitated above the track through the application of additional superconducting or non-superconducting magnets.

The primary coil magnets along with the secondary magnet and car, comprising the superconducting pulverizer are attached to a vehicle such as a standard mine scoop, or a specifically built 'mule' vehicle that is able to manipulate/move the pulverizer to wherever it is needed in the mine, to allow for connection of electrical power to energize the pulverizer, and to provide the inertia for momentum transfer to effectively operate the pulverizer. The momentum of the projectile upon release is projected for a 500 kg projectile @ 45 m/sec to be 22,500 kgm/sec. To minimize recoil of the pulverizer system attached to the vehicle, the mass of the vehicle is projected to be greater than 5,000 kg. Resulting recoil of the vehicle and pulverizer is then less than ~4.5 m/sec and can be accommodated by vehicle braking, anchoring the vehicle to the mine floor/walls through springs, or other confinement techniques.

DETAILED DESCRIPTION OF THE DRAWINGS

Referring now to FIGS. 1A&B, an embodiment of a superconducting electromagnetic projectile acceleration apparatus, generally 100, of this invention is shown to include a power supply component 102, a track component 120, and a projectile car component 160.

The power supply component 102 includes a current in cable 104 and a current out cable 106. The two cables 104 and 106 are connected to a DC power supply 108. The track component 120 includes a left side rail 122*a*, a right side rail 122*b*, and a central rail component 124. The left side rail 122*a* and right side rail 122*b* include central support members 126*a*&*b* and a plurality of conductive members 128*a*&*b* mounted on the support members 126*a*&*b*. The conductive members 128*a*&*b* include vertical sections 130*a*&*b*, a horizontal section 132*a*&*b* having top rail contacts 134*a*&*b* and L-shaped feet 136*a*&*b* having bottom rail contacts 138*a*&*b*. The conductive members 128*a*&*b* are all interconnected by the laterally extending conductive feet 136*a*&*b*. The left side rail 122*a* is connected to the current in cable 104 at the left rail contacts 138*a* disposed in bottom surfaces 140*a* of the feet 136*a;* while the right side rail 122*b* is connected to the current out cable 106 at right rail contacts 138*b* disposed in bottom surfaces 140*b* of the feet 136*b*.

The central rail component 124 includes a current in rail 142*a* having a current in bottom contact 144*a* disposed in a bottom surface 146*a* of a current in foot 148*a* and a current in top contact 150*a* disposed in its top current in rail surface 152*a*. The central component 124 also includes a current out rail 142*b* having a current out bottom contact 144*b* disposed in a bottom surface 146*b* of a current out foot 148*b* and a current out top contact 150*b* disposed in its top current out rail surface 152*b*. The current in bottom contact 144*a* is connected to the current in cable 104; while the current out bottom contact 144*b* is connected to the current out cable 106.

Figure 1B:
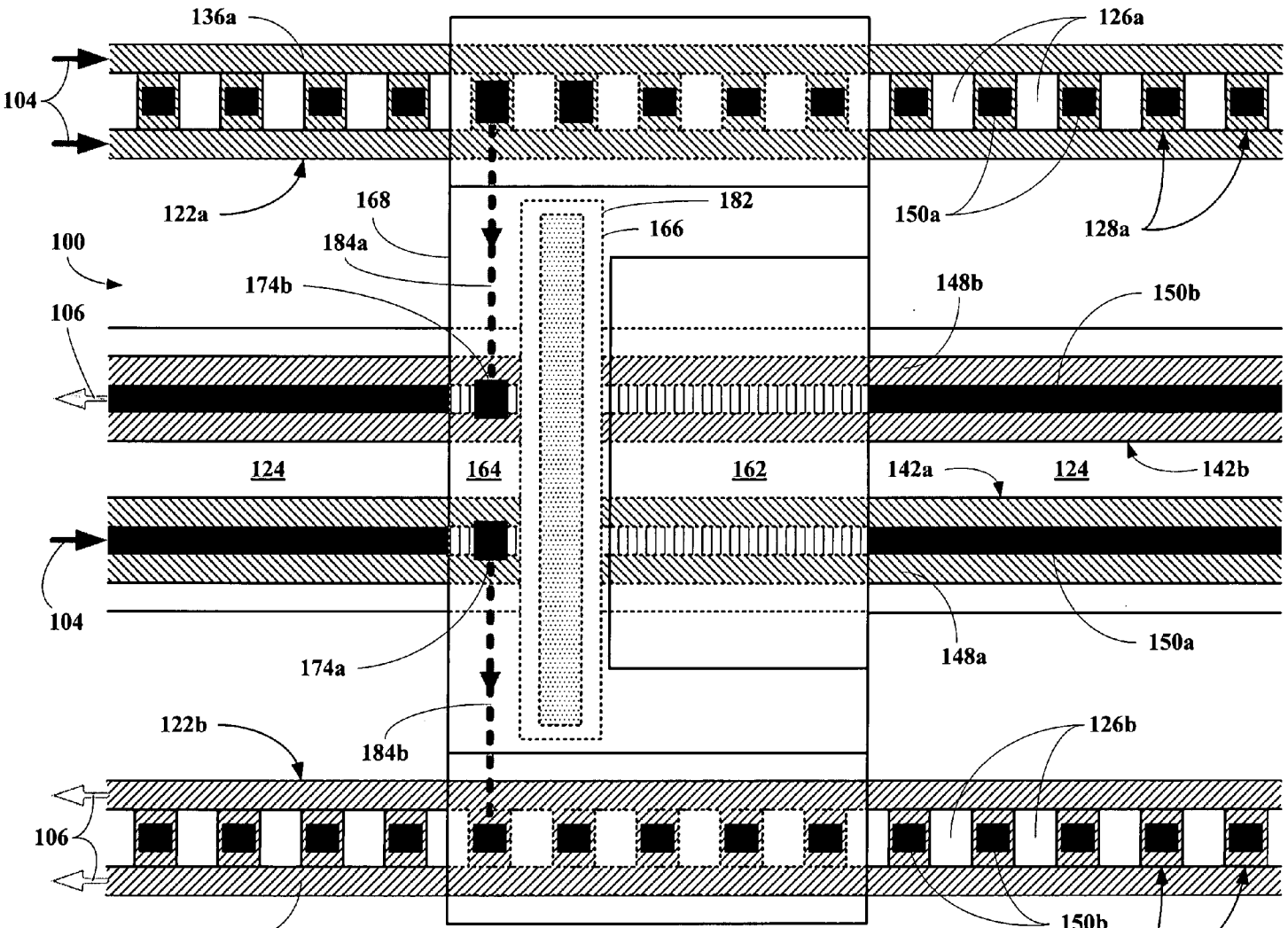
FIG. 1C depicts another embodiment of a track system of this invention.
FIG. 1D depicts another embodiment of a track system of this invention.

The car component 160 includes a projectile holder 162 mounted on a car body 164. The car body 164 includes a superconducting trapped field magnet 166 mounted laterally in an interior 163 of the body 164 near its proximal end 168 (FIG. 1B). The body 164 includes two current rail grooves 170*a*&*b* disposed in a bottom surface 172 of the body 164 having car bottom contacts 174*a*&*b* disposed in groove top surfaces 176*a*&*b*. The grooves 170*a*&*b* are adapted to engage the current in rail 142*a* and the current out rail 142*b* of the track component 140, respectively, so that the car bottom contacts 174*a*&*b* are brought into electrical contact or into electrical communication with the corresponding contacts 152*a*&*b* of the central rail component 124 of the track component 120. The car component 160 also includes two rail engaging U-shaped members 178*a*&*b* including car top contacts 180*a*&*b*. The U-shaped member 178*a*&*b* are adapted to surround and engage an upper section of the rails 122*a*&*b*, respectively, so that the car top contacts 180*a*&*b* are brought into electrical contact or into electrical communication with the top rail contacts 134*a*&*b* of the rails 122*a*&*b*. The body 164 also include a cryocooler 182 adapted to maintain the superconducting trapped field magnet 166 at or below it critical transition temperature, $T_c$. The top car contact 180*a* is connected to the bottom car contact 174*b* via a wire 184*a;* while the top car contact 180*b* is connected to the bottom car contact 174*a* via a wire 184*b*.

Figure 1C:
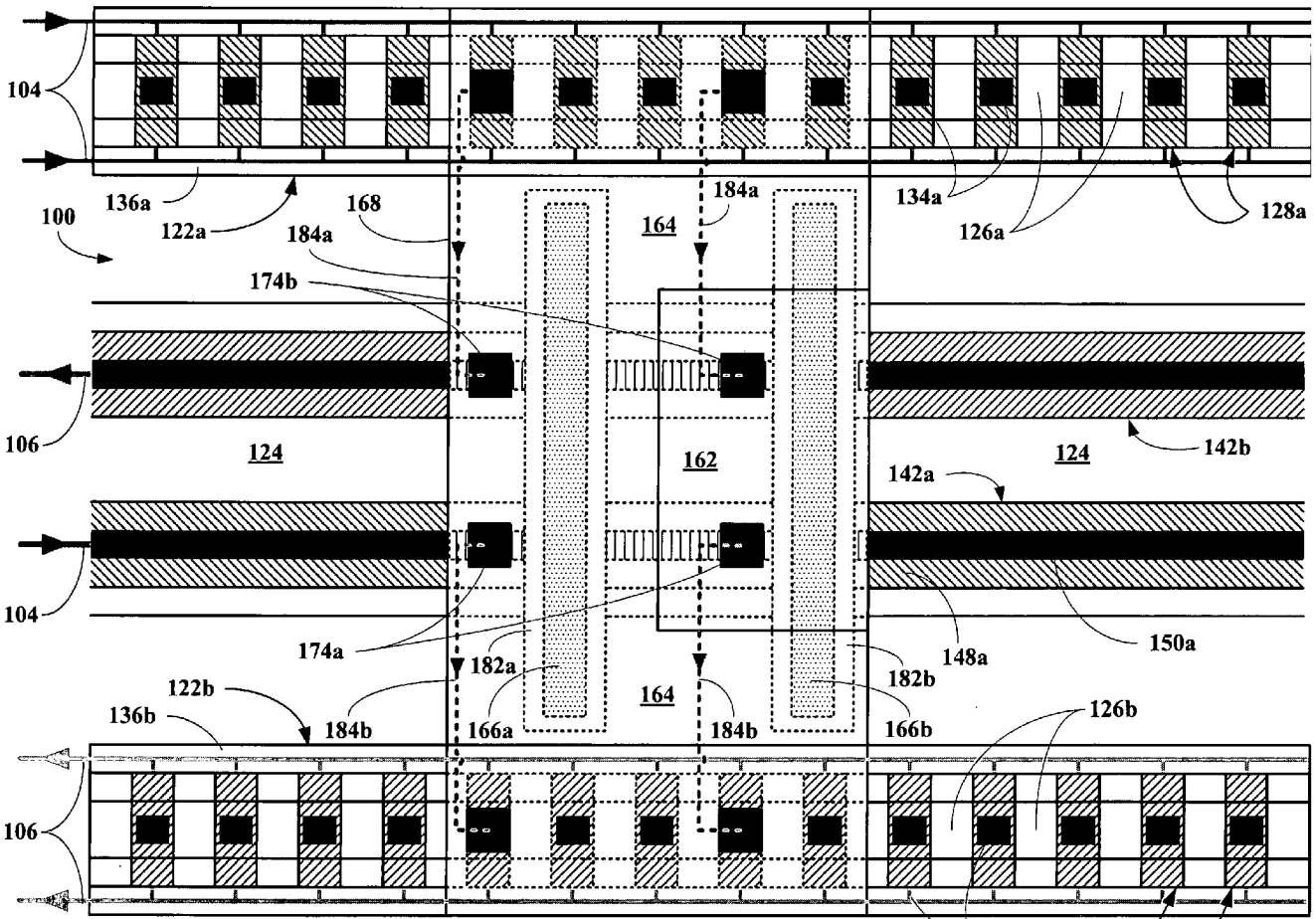

Referring now to FIG. 1C, another embodiment of a superconducting electromagnetic projectile acceleration apparatus, generally 100, of this invention is shown to include a power supply component 102, a track component 120, and a projectile car component 160. In this embodiment, the car body 164 includes two superconducting trapped field magnets 166*a*&*b* mounted laterally in the interior 163 of the car body 164, one near its proximal end 168 and one near its distal end 169. Each magnet 166*a*&*b* is contained within a separate cryocooler 182*a*&*b*, but the cryocooler 182*a*&*b* can be combined into a single cryocooler. Unlike the embodiment of FIGS. 1A&B, the feet 136*a*&*b* are non-conductive. Instead, each conductive member 128*a*&*b* is connected to the appropriate electrical cable 104 or 106 as shown so that they can be separately controlled. Although two superconducting trapped field magnets are disclosed herein, the car can have a higher number of superconducting trapped field magnets with accompanying contacts, limited only by the size of the car and the amount of acceleration to be imparted to the car. Generally, the upper limit will be less than 10 superconducting trapped field magnets.

Figure 1D:
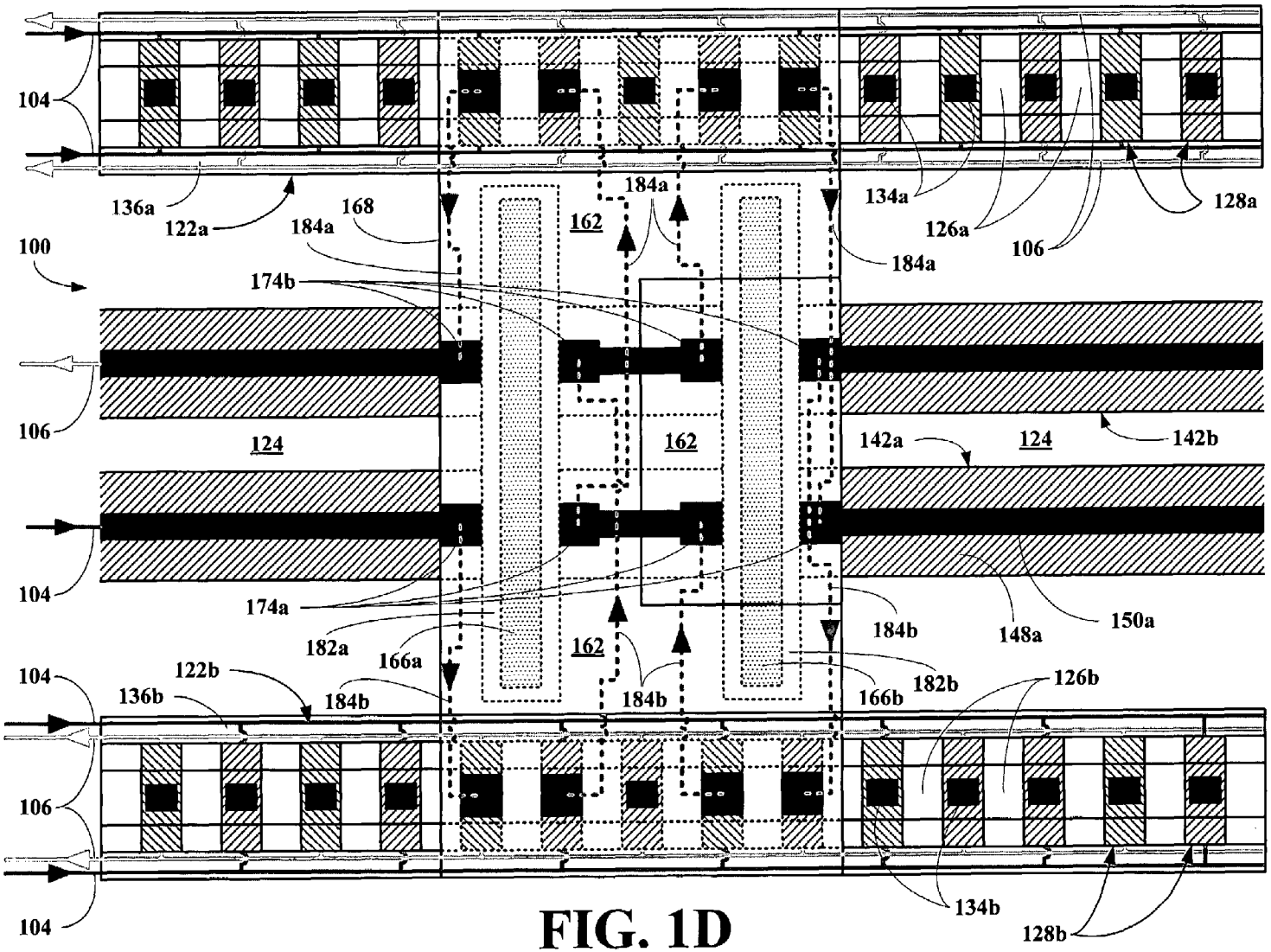

Referring now to FIG. 1D, another embodiment of a superconducting electromagnetic projectile acceleration apparatus, generally 100, of this invention is shown to include a power supply component 102, a track component 120, and a projectile car component 160. In this embodiment, the car body 164 includes two superconducting trapped field magnets 166*a*&*b* mounted laterally in the interior 163 of the car body 164, one near its proximal end 168 and one near its distal end 169. Each magnet 166*a*&*b* is contained within a separate cryocooler 182*a*&*b*, but the cryocooler 182*a*&*b* can be combined into a single cryocooler. The track component 140 includes isolated conductive members 128*a* and 128*b*. The car contacts are designed so that the magnets 166*a*&*b* are pushed by conductive members behind of the magnets and pulled by conductive members in front of the magnets. The push-pull configuration is controlled by the current direction flowing through the conductive members. In such a configuration, alternating conductive members on each rail 122*a* and 122*b* have current flowing in the opposite direction. Moreover, the two tracks are do not have the same current flow pattern, but one is one member offset so that the magnetic fields generated by the flowing current push and pull in unison. Although two superconducting trapped field magnets are disclosed herein, the car can have a single superconducting trapped field magnet or a higher number of superconducting trapped field magnets with accompanying contacts, limited only by the size of the car and the amount of acceleration to be imparted to the car. Generally, the upper limit will be less than 10 superconducting trapped field magnets.

Figures 2A, 2B, 2C:
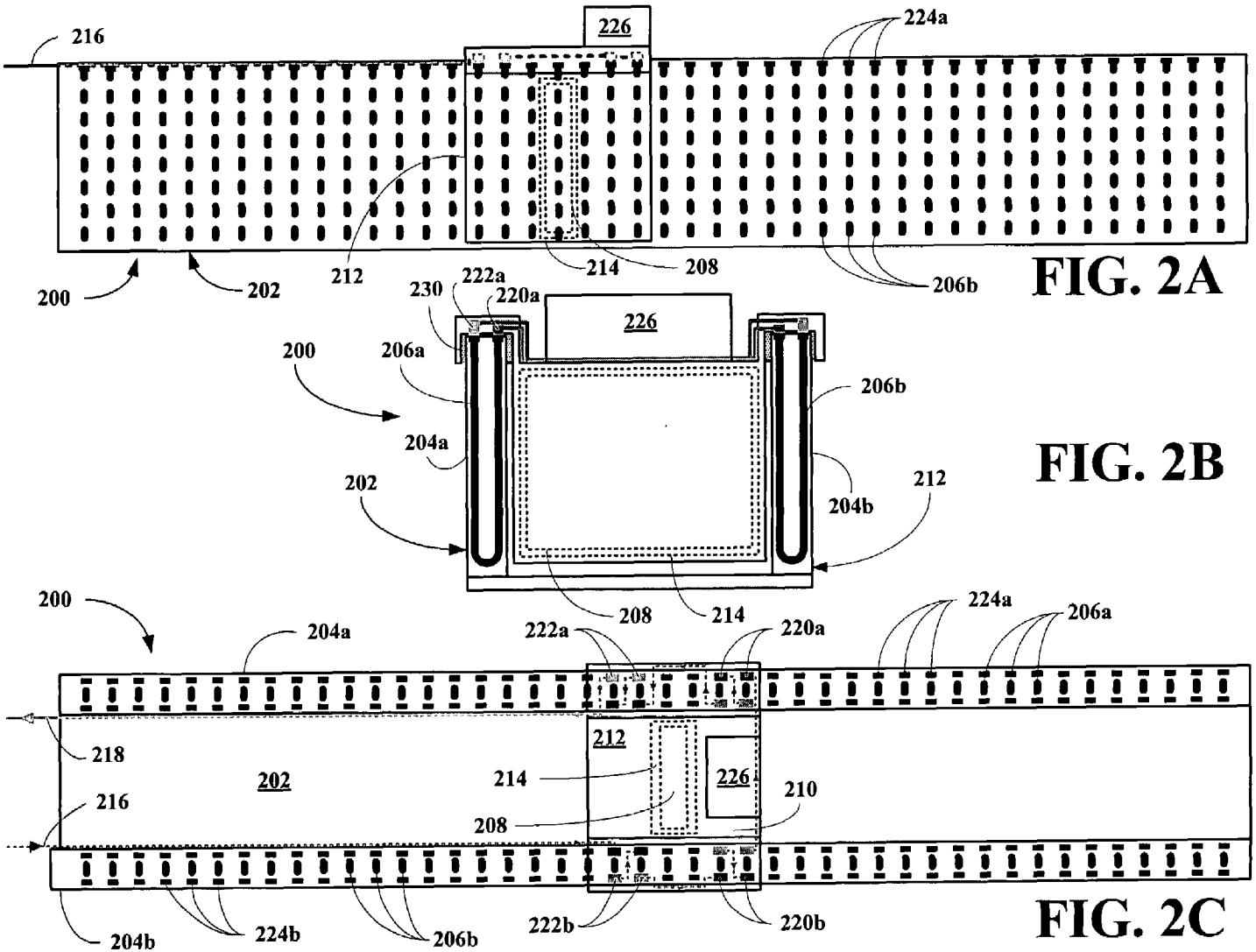
FIGS. 2A-C depicts another embodiment of a track system of this invention.

Referring now to FIG. 2A-C, another superconducting electromagnetic rock pulverizer track system 200 includes a dual-rail track component 202 having a left side rail 204*a* and a right side rail 204*b*, each rail including a plurality of primary coil magnet windings 206*a*&*b*, a superconducting trapped field magnet 208, which is mounted in an interior 210 of a car 212 riding on the primary magnet rails 204*a*&*b*. The field magnet 208 is enclosed in a thermally insulated cryocooler 214, which can be a contained filled with liquid nitrogen or other cryogenic fluid for keeping the superconducting magnet 208 at a temperature below its critical temperature. For example, if the superconducting field magnet 208 comprises YBCO, then the liquid is liquid nitrogen, 77K. The cryocooler can also be a cryocooler system to keep the superconducting magnet below its critical temperature. The car 212 moves on the track component 202 either on lubricated slides or on bearings or any other mechanism for reducing friction as one surface move on other surface. The system 200 also includes a power supply (not shown) to which are connected a current in cable 216 and a current out cable 218. The current in cable 216 is connected to current in contacts, brushes or leads 220*a*&*b* on the car 212 and the current out cable 218 is connected to current out contacts, brushes or leads 222*a*&*b* on the car 212. The current in contacts 220*a*&*b* and the current out contacts 222*a*&*b* are configured on the car 212 so that the windings 206*a*&*b* are charged through contacts or leads 224*a*&*b* on the windings 206*a*&*b* as the car 212 travels down the track component 202. The car 212 and the track component 202 are configured so that windings 206*a*&*b* are charged by the leads 220*a*&*b* and 222*a*&*b* so that the charged windings 206*a*&*b* push and pull against the field magnet 206 in the car 212 accelerating the car 212 from the first windings to the last windings. The car 212 of FIG. 2A-C, is designed so that four windings push and four winding pull the trapped field magnet. The car 212 also includes a projectile holder 226 into which projectiles are placed and ejected from the holder 226, when the car 212 is stopped suddenly at a distal end of the track system. The car 212 included two U-shaped rail engaging members 228. The member 228 engaged the rails 204*a*&*b* via a lubricated slid or bearings 230. Brushless non-contact system can also be used to energize of the windings as the car moves down the track. It should be recognized that the car can include numerous different contact patterns. For example, the car contacts can be configured so that only a single pair on windings push the car, only a single pair of winding pull the car, a single pair of windings push and a single pair pull, a plurality of windings push, a plurality of winding pull, or a plurality of windings pull and a plurality of winding push. The car can also be configured with one or more field magnets and any arrangement on contacts to charge the windings needed to accelerate the car from a start end of the track system to the stop end of the track system.

Figure 3B:
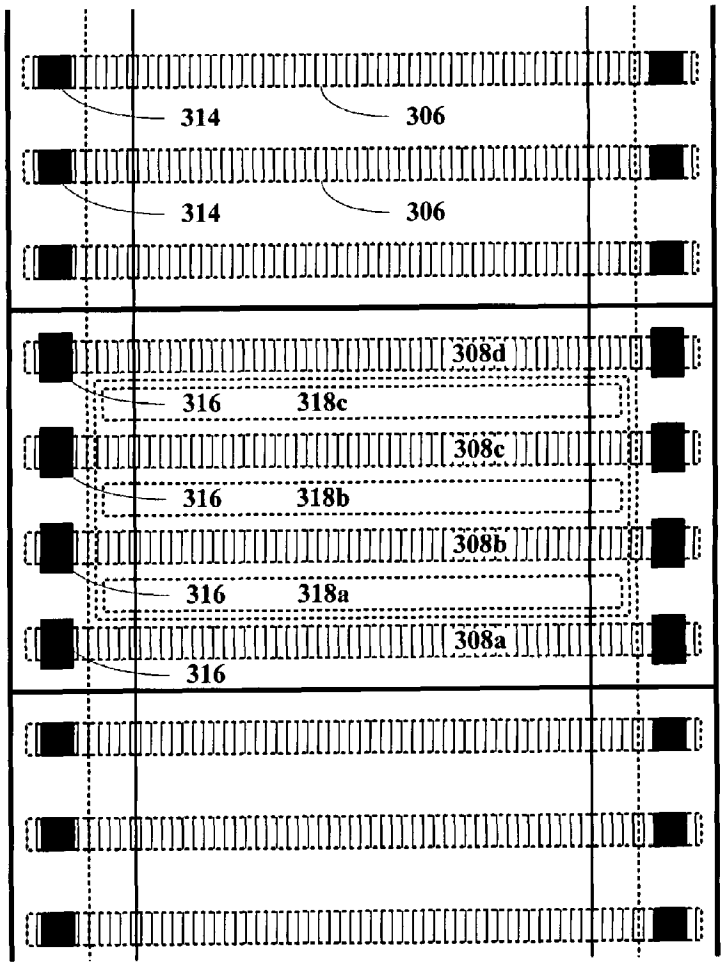
FIGS. 3A&B depicts another embodiment of a track system of this invention.
Figure 3A:
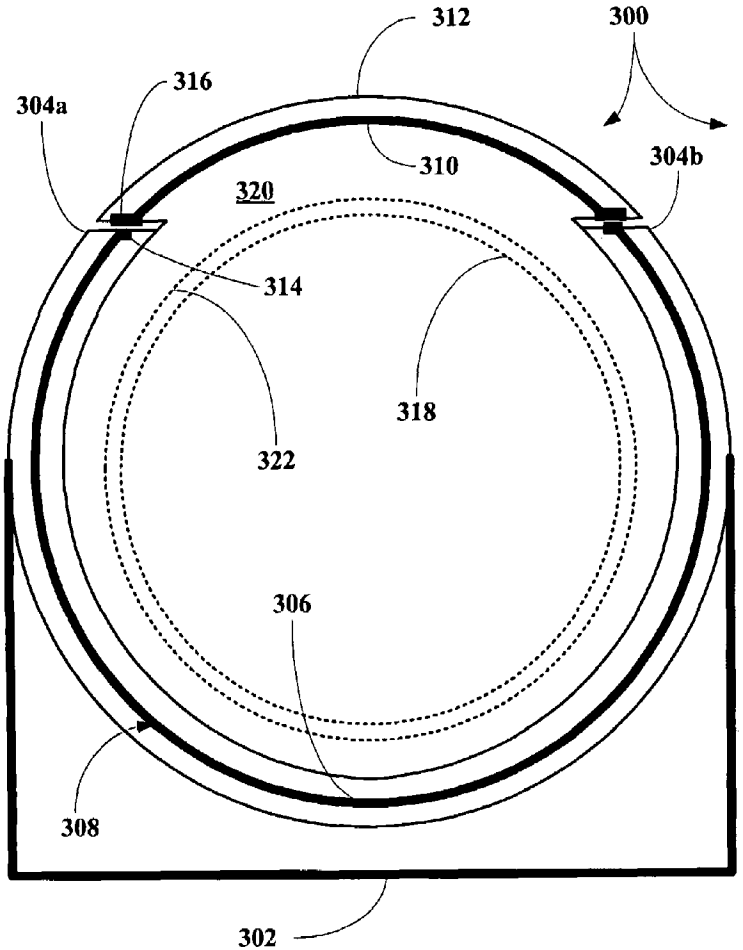

Referring now to FIGS. 3A&B, another superconducting electromagnetic rock pulverizer track system 300 is shown as a cylindrical shape. The system 300 includes a cut-cylindrical track component 302 having a left side rail 304*a* and a right side rail 304*b*. The system 300 also includes a plurality of lower portions 306 of primary windings 308. The lower portions 306 of the windings 308 are designed to be brought into electrical contact or communication with four upper portions 310 of the windings 308 disposed in a car component 312. The lower portions 306 and the upper portions 310 of the winding 308 are brought into electrical communication as the car component 312 travels down the track component 302 via track contacts, leads or bushes 314 and car contacts or leads 316. The car component also includes three superconducting trapped field magnets 318*a-c*. The windings 308*a-d* are closed by the contacts 314 and 316 and generate magnetic fields that push and pull the magnets 318*a-c*, when power is supplied to the four completed windings 308*a-d*. The magnets 318*a-c* are disposed in an interior 320 and contained within a cryocooler 322.

Figure 4B:
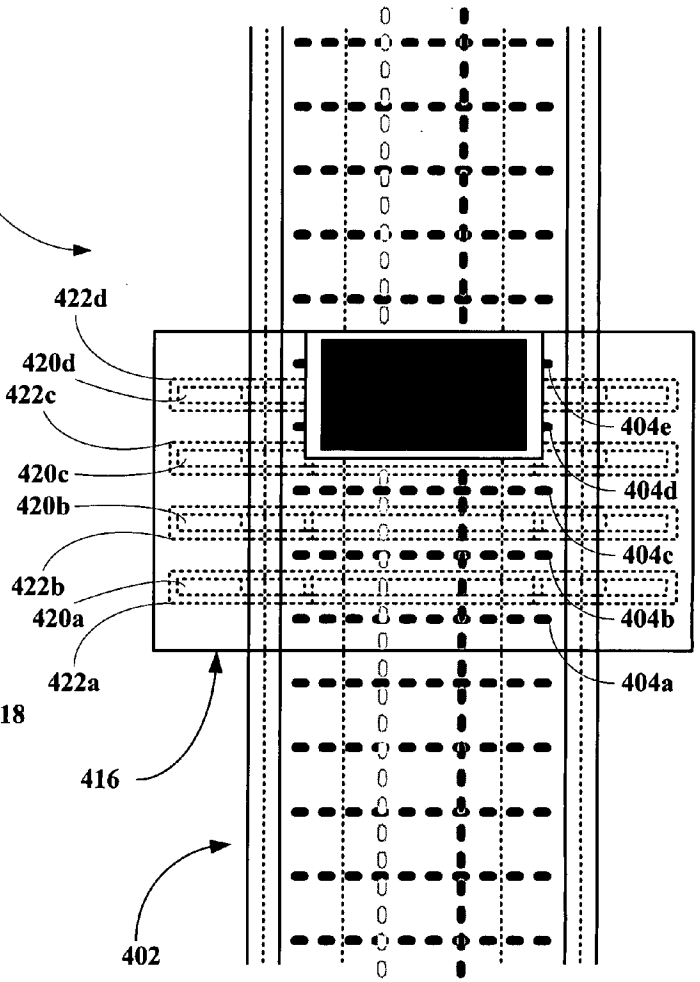
FIGS. 4A&B depicts another embodiment of a track system of this invention.
Figure 4A:
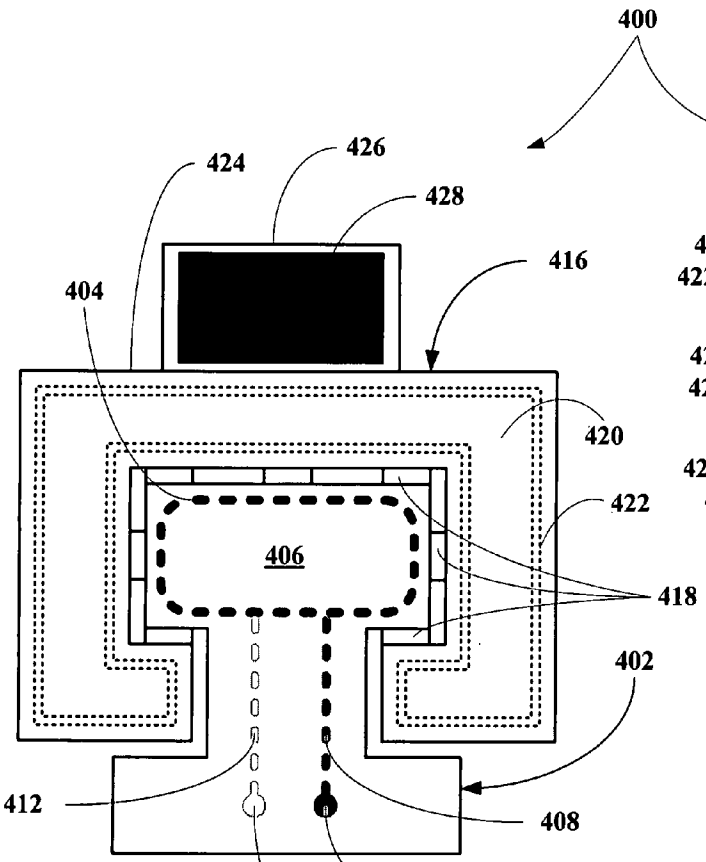

Referring now to FIGS. 4A&B, another superconducting electromagnetic rock pulverizer track system 400 is shown as a monorail. The system 400 includes a monorail track component 402. The system 400 also includes a plurality of primary windings 404 contained in an upper portion 406 of the monorail 402. Each winding 404 includes a current in lead 408 connected to a current in cable 410 and a current out lead 412 connected to a current out cable 414. The system 400 also includes a car component 416 mounted on the monorail 402 and riding on bearings or lubricated slides 418. The car 416 includes four superconducting trapped field magnets 420*a-d* contained in cryocoolers 422*a-d*. The windings 404*a-e* are energized by a control system located on a vehicle used to maneuver the system 400 adjacent a surface to be pulverized. Thus, the car 416 is accelerated down the track 402 via a controlled turning on and off windings 404 as the car 416 moves down the track 402. Mounted on a top 424 of the car 416 is a projectile holder 426 holding a projectile 428. When the car 416 is rapidly decelerated as shown in FIGS. 5A-B, the projectile 416 is ejected from the holder and impinges on the surface.

Figure 5B:
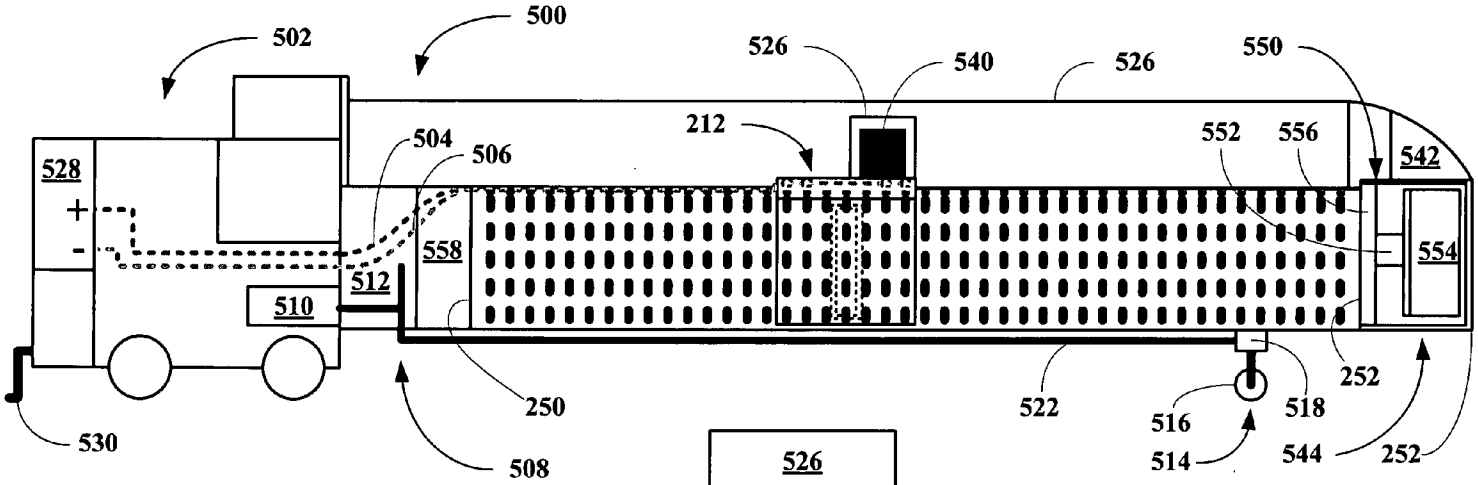
FIG. 5B depicts another vehicle apparatus of this invention.
Figure 5C:
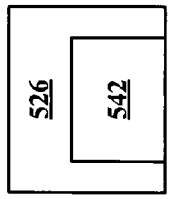
FIG. 5C depicts a front view of a track shield of this invention.
Figure 5A:
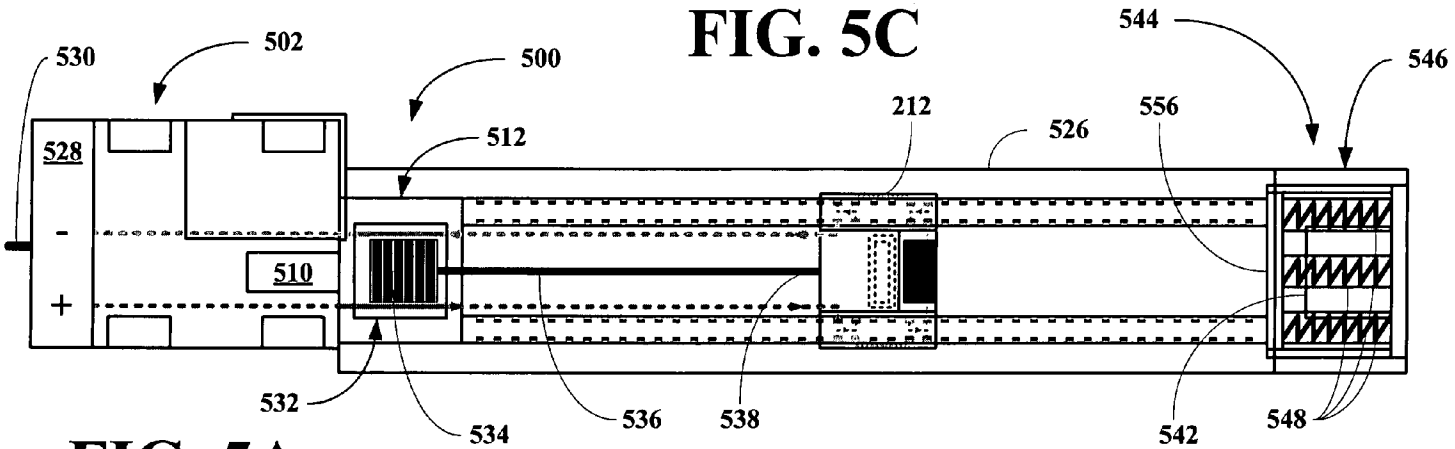
FIG. 5A depicts a vehicle apparatus of this invention.

Referring now to FIGS. 5A&B, two embodiments of a pulverizing vehicle apparatus, generally 500, are shown to include the track system 200, but track system 100, 300, or 400 can be used as well, is mounted at its proximal end 250 on a vehicle 502 for movement and positioning of the track system 200 to a desired location; for example, the vehicle can be a vehicle used in a mine so that the track system 200 can be positioned adjacent a surface to be pulverized. The vehicle 502 also includes command and control equipment for the track system 200, and a power supply for supplying electrical energy to the track system 200, via current in and current out cables 504 and 506, respectively. The vehicle 502 can be a standard mine scoop modified to accept the track systems 200, or a specifically designed and built "mule" vehicle.

The track system 200 is attached to the vehicle 502 via a hydraulic system 508 including a hydraulic reservoir pump unit 510, a track raising/lowering unit 512 and a hydraulically adjustable wheel assembly 514 having a wheel 516 and a hydraulic lift unit 518 positioned near a distal end 520 of the apparatus 500 as shown in FIG. 5B. The pump unit 510 is connected to the track raising/lowering unit 512 and the lift unit 514 via hydraulic lines 522. The hydraulic system 510 is adapted to raise or lower the track system 200 or to move the track system 200 from side-to-side so that the distal end 520 of the apparatus 500 can be positioned adjacent a projectile target surface.

The vehicle 502 also supports blast shields 524 and 526 to protect the operator and the components of the track system 200, respectively. The vehicle 504 also contains an electrical energy storage system 528, which activates the primary windings or conductive elements of the track system 200 via the current in and out cables 504 and 506. The apparatus 500 can use capacitors, flywheels, batteries, superconducting magnetic energy storage or other energy storage devices not shown connected to the system 528 via umbilical 530. The vehicle 502 can also contain a separate electrical energy source for energizing the primary coil circuits. This source could be a generator, fuel cell, or other electrical generation system not shown.

The apparatus 500 also includes a mechanized reel mechanism 532 having a reel 534 and a control cable 536 wound onto the reel 534 with a cable's distal end 538 attached to the car system 212 as shown in FIG. 5A. The mechanism 532 is adapted to pay-out the cable 536 as the car system 212 is accelerated down the track component 202, and to reel-in of the car 212 back to the proximal end 250 of the track system 200 after a projectile 540 contained within the car holder 226 is released. The blast shield 526 is shown in a front view in FIG. 5C to have an opening 542 therein to permit the projectile 540 to be ejected through the shield 526.

The apparatus 500 also includes a deceleration system 544 disposed at its distal end 520 and attached to a distal end 252 of the track system 200. The deceleration 544 system can include electromagnetic windings (not shown) that can be energized to slow down and stop the car component 212 of the track system 200. The deceleration system 544 can also be a shock-in-spring deceleration system 546 as shown in FIG. 5A. The shock-in-spring deceleration system 546 includes a plurality of spring units 548, which can be traditional springs or shock absorbers including springs and/or air springs. The deceleration system 544 can also be an air compressions unit 550 including a piston 552 moving in a cylinder 554, where compressing air provided the deceleration necessary to stop the car and eject the projectile 540. The deceleration system 544 can also be of varying design from the shock-in-spring design. The deceleration system 544 includes a contact plate 556 that can be a rubberized pad to assist in shock reduction of the car system 212 upon contact with the deceleration plate 556 as shown in FIG. 5B. The deceleration plate 556 can be supported on slide bearings moving on rods attached to the track system.

The projectile 540 is carried in the holder 226 attached to the car system 212. The holer 226 can includes a cable/reel system (not shown) for use with tethered projectiles. The cable/reel system for tethered projectiles is adapted to be mounted on the distal end 520 of the apparatus 500 so that the tethered projectiles can be retrieved after ejection and reused. If a rock is used, then the tethering can be to a wire mesh holding the rock, but generally, for dispensable projectiles such as rock, no tethering system is needed. Although several stopping and rewind system have been disclosed, the car itself as mentioned previously can have on-board braking systems that will brake the car once it has progressed a given distance down the track. The car can also be retracted by simply reversing the current path. This will push/pull the car from the distal end of the track to the proximal end of the track. The current flow can then be reversed for acceleration of the car down the track. If magnetic force is used to restore the car to its start position, then a boost unit can be positioned at the distal end of the track to start the car on its return to the start position.

The apparatus 500 can also include a car boost unit 558 designed to push the car 212 to start it in motion before or simultaneous with electromagnetic activation. The boost unit 558 can be a hydraulic ram unit, air ram unit, a compressed spring or other acceleration boost device, that includes a push member that is thrust out from the unit pushing the car in to motion. The boost unit 558 can an air or hydraulic ram, a compressed spring, or other acceleration device The operation of the superconducting electromagnetic rock pulverizing system 500 is as follows. The projectile 540, either tethered or un-tethered, is loaded onto the projectile holder 226 attached to the car system 212 located on the track component 202 positioned at the proximal end 250 of the track component 202. The superconducting trapped field magnet 208, which is at or below is critical temperature, $T_c$, is magnetized, if it is not already magnetized. There is also the possibility not shown of using a permanent magnet in place of the superconducting magnet especially in the cases where lower mass projectiles are to be used.

The vehicle 502 is connected to the mine electrical power system through umbilicals 530 or contains its own power generating system, and the electrical energy storage system 528 on the vehicle 502 is energized. The vehicle 502 is moved to place the projectile ejection end 520 of the apparatus 500 adjacent a surface to be pulverized. Exact placement of the track end will be defined by trained operators. Fine positioning of the end of the track can be accomplished through the hydraulic system 510.

Once the area around the pulverizer system 500 is cleared of personnel other than the system operators who are behind protective blast shields 524 and 526 on the vehicle 502, the primary magnet windings 206 are energized generating magnetic fields the act on the superconducting field magnet 208. This causes the car system 212 to move down the track 202 accelerating every time a new set of primary windings 206 are energized by the brush or brushless contacts on the car 212. This acceleration continues down the length of the track 202 with the car system 202 supporting the projectile 540 reaching a design velocity nominally 45 m/sec for a 500 kg projectile at the end of the nominally 10 m long track. The last 1 m of the track is a deceleration section where the car system is decelerated and the projectile 500 is ejected from the support basket 226 attached to the car 212. The deceleration of the car 212 can be accomplished by a passive spring over shock system, or by electromagnetic deceleration from reverse current applied to primary coils located at the last 1 m of track, or by a combination of both systems.

The ejection of the projectile 500 from the car basket 226 when the car system 212 reaches the distal end 252 of the track 202 is followed by reel-out of the projectile tether for tethered projectiles. After collision of the projectile 540 with the rock, the tether is used to reel the projectile 540 back onto the car basket 226. The car system 212 along with the tethered projectile 540 is then reeled back to the vehicle end 250 of the track 202 in preparation for the next pulverizing event.

Blast shields 524 and 526 are strategically mounted near the end of the track to protect the track and secondary magnet/car system as well as any primary magnet windings 206 from shrapnel from flying rock.

The vehicle 502 can include a DC power supply 528 and necessary control systems to allow the operator to turn on the power supply once the apparatus is properly positioned. The control system can also be used to change the current being delivered to the conductive members of the track. Thus, the current can start off at just the current necessary to start the car moving and increased to increase the acceleration being imparted to the car. Of course, the current density must be kept below the maximum current of the cables and the maximum current capable of being tolerated by the conductive members.

The apparatus operates by pulling the car to the proximal end of the track component. Next, one or more projectiles are placed on the projectile holder. The car is then accelerated by turning on the DC power supply so that current flows through the feet to the conductive member activated by the car contacts. The current flowing through the conductive members generates a magnetic field that pushes against the superconducting trapped field magnet. Each subsequently activated conductive member continues the acceleration down the track on the rails. The power supply can be adjustable so that the current density is increased as the car moves down the track. At the end of the track, the car is stopped by a breaking system that is generally biased. The stopping is sudden enough to propel the projectiles from the projectile holder at a surface or into a surface of a structure or formation to breakup or pulverize a portion of the surface contacted by the expelled projectiles. The projectiles can be stones or rocks or can be special projectiles designed to more effectively penetrate, breakup or pulverize the surface. The projectiles can be explosively charged. The projectiles can be shaped to spin once be expelled from the holder.

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

The invention claimed is:

1. A apparatus for ejecting a projectile at a surface comprising:

a track system including:

at least one rail, a plurality of electromagnets disposed along a length of the track system, and a moveable car system including:

a car mounted on the at least one rail, and a trapped field magnet mounted in an interior of the car and disposed parallel to a front and back of the car, a power supply system adapted to provide power to energize one or more of the plurality of electromagnets in such a manner as to accelerate the car system down the track system;

a car deceleration system adapted to decelerate the car at a rate sufficient to expel or eject a projectile mounted on the car so that the projectile impinges upon a target surface.

2. The apparatus of claim 1 further comprises:

a vehicle attached to a proximal end of the track system and adapted to position a distal end of the apparatus adjacent the target surface, where the vehicle includes the power supply system and a hydraulic system adapted to raise or lower the track system and to move the track system side-to-side to achieve a desired placement.

3. The apparatus of claim 1, wherein the track system comprises a single rail.

4. The apparatus of claim 1, wherein the track system comprises a right side rail and a left side rail.

5. The apparatus of claim 1, wherein the track system comprises multiple rails.

6. The apparatus of claim 1, wherein the field magnet is a superconducting magnet.

7. The apparatus of claim 6, wherein the superconducting magnet is cooled by liquid nitrogen or liquid helium.

8. The apparatus of claim 6, wherein the car system further includes a cryocooler surrounding the field magnet adapted to maintain the field magnet at or below a critical temperature of the superconducting magnet.

9. The apparatus of claim 6, wherein the superconducting trapped field magnet is particularly shaped from superconducting elements to yield maximum magnetic force for acceleration.

10. The apparatus of claim 6, wherein the superconducting trapped field magnet is composed of $YBa_2Cu_3O_{7-x}$, BiSrCaCuO in its various superconducting phases, ThSrCaCuO in its various superconducting phases, HgSrCaCuO in its various superconducting phases, $MgB_2$, TiNb, or any other superconducting material or mixtures or combinations thereof.

11. The apparatus of claim 1, wherein the field magnet is a non-superconducting permanent magnet.

12. The apparatus of claim 1, wherein the electromagnets comprise wire wound magnets comprising of copper wires, aluminum wires, other metallic wires, or mixture or combinations thereof.

13. The apparatus of claim 1, wherein the electromagnets comprise wire wound magnets comprising superconducting wire, where superconductors are selected from the group consisting of $YBa_2Cu_3O_{7-x}$, BiSrCaCuO in its various superconducting phases, ThSrCaCuO in its various superconducting phases, HgSrCaCuO in its various superconducting phases, $MgB_2$, TiNb, other superconducting materials and mixtures or combinations.

14. The apparatus of claim 13, wherein the superconducting electromagnets are enclosed in an insulated vessel which allows for cooling of the superconducting wires to a temperature below its critical temperature, Tc.

15. The apparatus of claim 1, wherein the electromagnets comprise multiple levels of primary wire wound magnets.

16. The apparatus of claim 1, wherein the field magnet and the electromagnets form a linear motor acceleration system adapted to accelerate the car to a speed of up to 100 m/sec.

17. The apparatus of claim 1, wherein the track system has a length between 3 meters and 15 meters.

18. The apparatus of claim 2, wherein the hydraulic system includes a hydraulic reservoir pump unit, a track raising/lowering unit and a hydraulically adjustable wheel assembly having a wheel and a hydraulic lift unit positioned near a distal end of the apparatus.

19. The apparatus of claim 1, wherein the car moves on the track rails on slides or bearings.

20. The apparatus of claim 1, further comprising a boost unit adapted to start the car system moving on the rail.

21. The apparatus of claim 1, wherein the moveable car is tethered to a reel at the fixed end of the track for return of the car to a start position.

22. The apparatus of claim 1, wherein the movable car has an integral braking mechanism adapted to decelerate the car before the car reaches the distal end of the track system.

23. The apparatus of claim 1, wherein the car system further includes a projectile holder mounted on a top of car and adapted to hold and partially confine a projectile placed therein.

24. The apparatus of claim 1, wherein the car system further includes a reel and tether attached to the holder or to the car, where a distal end of the tether is attached to the projectile so that the projectile can be retrieved for reuse.

25. The apparatus of claim 2, wherein the vehicle is a standard mine scoop vehicle.

26. The apparatus of claim 2, wherein the vehicle is a specifically designed support vehicle.

27. The apparatus of claim 1, further comprising umbilical cables to connect the apparatus to an external electrical power source.

28. The apparatus of claim 2, wherein the vehicle further includes an electric charge storage system to energize the electromagnets and the field magnet.

29. The apparatus of claim 2, wherein the vehicle further includes an integral generator or fuel cell system to energize the electromagnets and the field magnet.

30. The apparatus of claim 1, wherein the apparatus has a mass commensurate with realized recoil velocity of ~4 m/sec and where the mass depends on projectile mass and ejection velocity.

31. The apparatus of claim 2, wherein the vehicle has an inertial transfer system, which is attached to a fixed surface through cables, springs or other mechanisms to absorb the inertial load of the vehicle after the projectile is ejected.

32. The apparatus of claim 1, the projectile is tethered and comprises tungsten carbide, WC, steel or other massive and durable material.

33. The apparatus of claim 1, the projectile is un-tethered and comprises a rock or other massive object.

34. The apparatus of claim 31, the projectile has a mass between 50 to 2000 kg.

35. The apparatus of claim 1, the deceleration system comprises of a shock-in-spring mechanism.

36. The apparatus of claim 1, the deceleration system comprises a mechanical braking mechanism.

37. The apparatus of claim 1, the deceleration system comprises wire wound magnet coils disposed in the distal end of the track system through which reverse current can be passed creating a repulsive force on the field magnet slowing the car to a stop.

38. The apparatus of claim 1, the deceleration system further comprises a flexible wire mesh extension netting to help capture and return a tethered projectile on to the car for re-activation.

39. The apparatus of claim 1, the deceleration system further comprises other flexible extension netting comprised of Kevlar, Teflon, polyethylene or other durable and tough fabrics.

40. The apparatus of claim 1, further comprising protective blast plates adapted to protect the track system and operating personnel.

41. A method for expelling a projectile into a target surface comprising the steps of:

positioning a distal end of a projection ejection apparatus adjacent the target surface, where the apparatus comprises:
- a track system including:
  - at least one rail,
  - a plurality of electromagnets disposed along a length of the track system, and
- a moveable car system including:
  - a car mounted on the at least one rail, and
  - a trapped field magnet mounted in an interior of the car and disposed parallel to a front and back of the car,
- a power supply system adapted to provide power to energize one or more of the plurality of electromagnets in such a manner as to accelerate the car system down the track system;
- a car deceleration system adapted to decelerate the car at a rate sufficient to expel or eject a projectile mounted on the car so that the projectile impinges upon a target surface;

placing a projectile on the car, positioning the car at the proximal end of the track system, energizing the field magnet, energizing in consecutive order to accelerate the car down the track, decelerating the car near a distal end of the track system at a rate sufficient to eject the projectile into the target surface at a desired projectile speed.

* * * * *